US009738482B2

(12) United States Patent
Aoyagi

(10) Patent No.: US 9,738,482 B2
(45) Date of Patent: Aug. 22, 2017

(54) DISCHARGED SHEET ACCOMMODATING DEVICE

(71) Applicant: FUJI XEROX CO., LTD., Tokyo (JP)

(72) Inventor: Keiichi Aoyagi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/473,143

(22) Filed: Aug. 29, 2014

(65) Prior Publication Data

US 2015/0266695 A1 Sep. 24, 2015

(30) Foreign Application Priority Data

Mar. 24, 2014 (JP) ..... 2014-059393

(51) Int. Cl.
*B65H 31/00* (2006.01)
*B65H 37/06* (2006.01)

(52) U.S. Cl.
CPC ..... *B65H 37/06* (2013.01); *B65H 2801/06* (2013.01)

(58) Field of Classification Search
CPC ..... B65H 31/00; B65H 31/04; B65H 31/08
USPC ..... 271/207, 209, 213, 223, 224; 400/625; 399/384, 405; 270/58.13, 58.28
See application file for complete search history.

(56) References Cited

U.S. PATENT DOCUMENTS

| | | | | |
|---|---|---|---|---|
| 3,046,010 | A * | 7/1962 | Schneider | B65H 31/00 271/219 |
| 6,568,865 | B1 * | 5/2003 | Fujioka et al. | 400/647.1 |
| 7,328,894 | B2 * | 2/2008 | Terao et al. | 270/58.15 |
| 7,364,149 | B2 * | 4/2008 | Terao et al. | 270/58.13 |
| 8,256,759 | B2 * | 9/2012 | Dobashi | 270/58.18 |
| 2003/0053834 | A1 * | 3/2003 | Suzuki | G03G 15/6514 399/392 |
| 2005/0280202 | A1 * | 12/2005 | Vila et al. | 271/213 |
| 2007/0077110 | A1 * | 4/2007 | Bartman | 400/646 |

FOREIGN PATENT DOCUMENTS

| | | |
|---|---|---|
| JP | A-2003-073015 | 3/2003 |
| JP | A-2005-082389 | 3/2005 |

* cited by examiner

*Primary Examiner* — Thomas Morrison
(74) *Attorney, Agent, or Firm* — Oliff PLC

(57) ABSTRACT

Provided is a discharged sheet accommodating device including a support shaft that has an axial center and is mounted on an apparatus body of an image forming apparatus that is provided with an outlet port from which a recording material is discharged, a first support portion that is provided to be fixed to a lower end of the support shaft, a second support portion into which the support shaft is movably inserted, a holding member of which one end is supported by the first support portion and the second support portion, and which is movable in an up and down direction and in a horizontal direction, and a receiving member of which one end is fixed to the support shaft and the other end is held by a leading end portion of the holding member to foe extensible and contractable, and which receives the recording material.

14 Claims, 6 Drawing Sheets

DISCHARGED SHEET ACCOMMODATING DEVICE

CROSS-REFERENCE TO RELATED APPLICATIONS

This application is based on and claims priority under 35 USC 119 from Japanese Patent Application No. 2014-059393 filed Mar. 24, 2014.

BACKGROUND

Technical Field

The present invention relates to a discharged sheet accommodating device.

SUMMARY

According to an aspect of the invention, there is provided a discharged sheet accommodating device including:

a support shaft that has an axial center in a vertical direction and is mounted on an apparatus body of an image forming apparatus that is provided with an outlet port from which a recording material is discharged;

a first support portion that is provided to be fixed to a lower end of the support shaft in an axial center direction;

a second support portion into which the support shaft is movably inserted;

a holding member of which one end is supported by the first support portion and the second support portion, and which is movable in an up and down direction and in a horizontal direction while being folded; and a receiving member of which one end is fixed to the support shaft and the other end is held by a leading end portion of the holding member to foe extensible and contractable, and which receives the recording material.

BRIEF DESCRIPTION OF THE DRAWINGS

Exemplary embodiments of the present invention will be described in detail based on the following figures, wherein.

DETAILED DESCRIPTION

Figure 1:
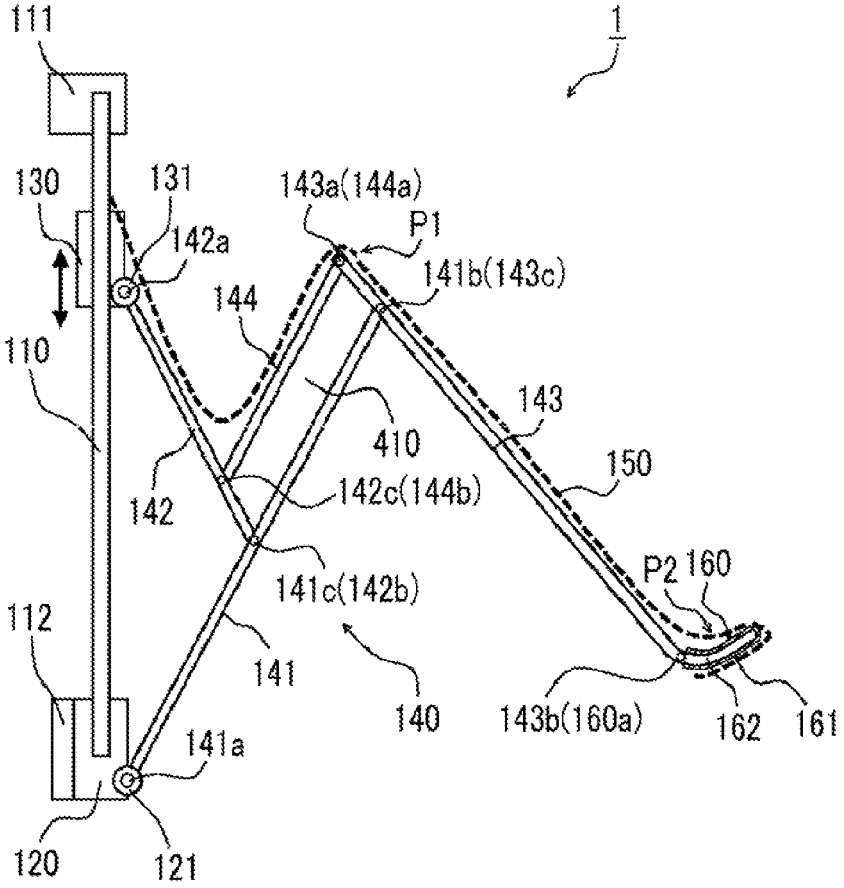
FIG. 1 is a schematic view illustrating the entire configuration of a discharged sheet accommodating device.

The invention will now be described in more detail using the following exemplary embodiments and specific examples with reference to the drawings, bat the invention is not limited to the exemplary embodiments and the specific examples.

In addition, in the following description which uses the drawings, it should be noted that the drawings are schematic and the ratios of the dimensions and the like are different from these in reality, and for ease of understanding, illustration of members other than the members that need an explanation is appropriately omitted.

For ease of understanding of the following description, in the drawings, the forward and backward direction is referred to as an X-axis direction, the left and right direction is referred to as a Y-axis direction, and the up and down direction is referred to as a Z-axis direction.

(1) Configuration and Operation of Discharged Sheet Accommodating Device

Figure 2:
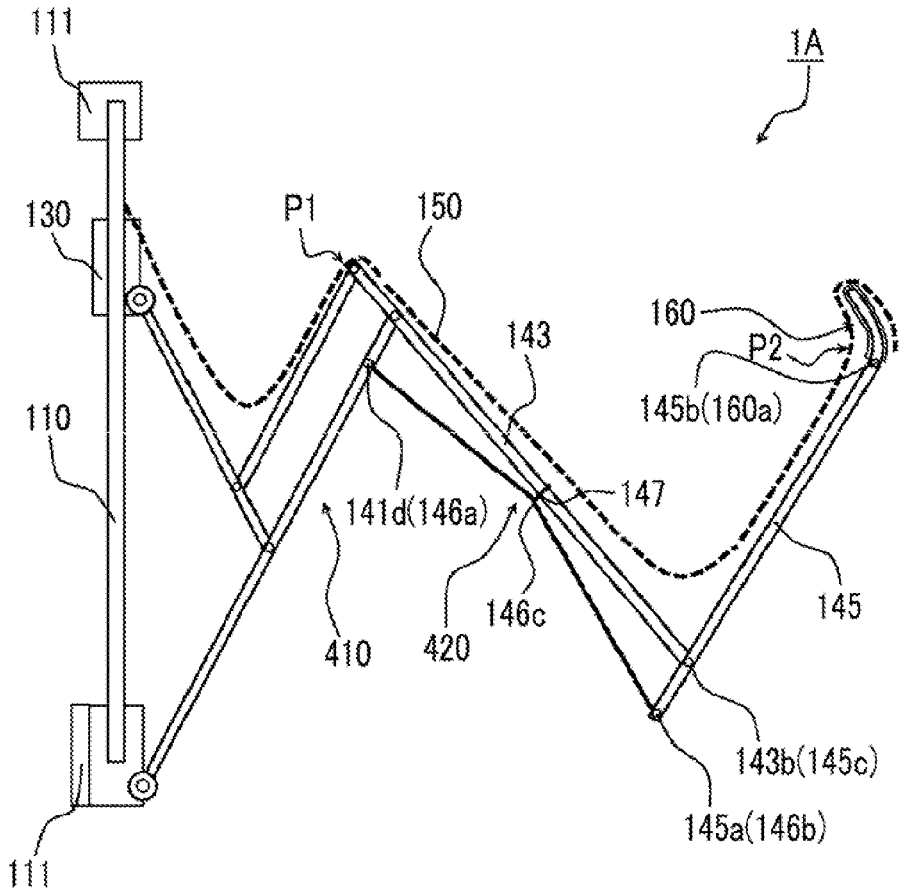
FIG. 2 is a schematic view illustrating the entire configuration of the discharged sheet accommodating device having a holding member according to a modification example.
Figure 3B:
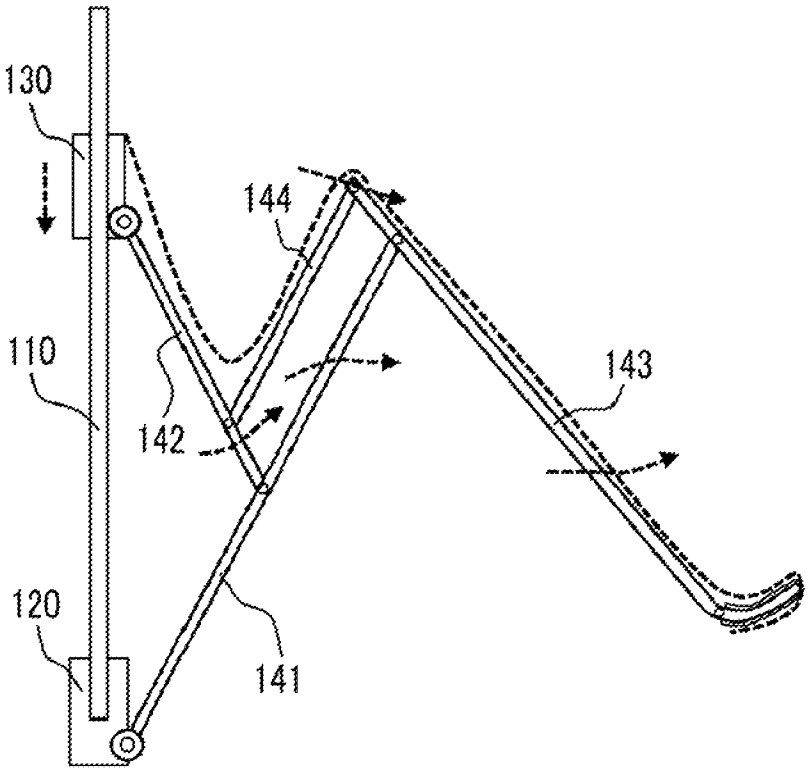
FIG. 3B is a schematic view illustrating an operation of deploying the discharged sheet accommodating device from the closed state.
Figure 3A:
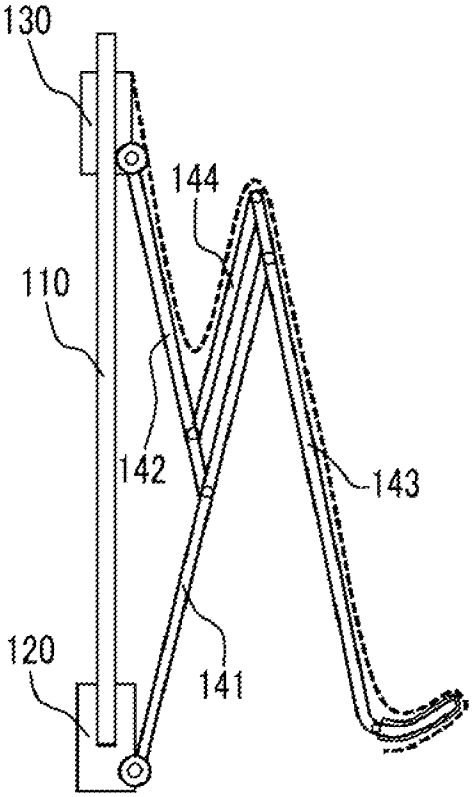
FIG. 3A is a schematic view illustrating a state in which the discharged sheet accommodating device is closed.

FIG. 1 is a schematic view illustrating the entire configuration of a discharged sheet accommodating device 1 according to this exemplary embodiment, FIG. 3A is a schematic view illustrating a state in which the discharged sheet accommodating device 1 is closed, FIG. 3B is a schematic view illustrating an operation of deploying the discharged sheet accommodating device 1 from the closed state, and FIG. 2 is a schematic view illustrating the entire configuration of a discharged sheet accommodating device 1A having a holding member 140A according to a modification example.

Hereinafter, the entire configuration and the operation of the discharged sheet accommodating device 1 will be described with reference to the drawings.

(1.1) Entire Configuration of Discharged Sheet Accommodating Device

The discharged sheet accommodating device 1 according to this exemplary embodiment is configured to include a support shaft 110, a first support portion 120, a second support portion 130, a holding member 140, and a receiving member 150, and the support shaft 110 is connected to the side surface of the apparatus body of the image forming apparatus 2 where the sheet outlet port is provided to be used.

(1.2) Support Shaft

The support shaft 110 is a pipe which is columnar in overall shape, and both end portions thereof are supported and fixed to the side surface of the apparatus body of the image forming apparatus 2 where the sheet outlet port is provided, by fixing members 111.

The fixing member 111 is fixed to a side surface 2*a* of the apparatus body using a fixing unit. The fixing unit is not particularly limited, and may employ a well-known method, for example, screwing, adhesion, or locking.

(1.3) Support Portion

A support portion is constituted by the first support portion 120 provided to be fixed to the lower end of the support shaft 110 in the axial center direction and the second support portion 130 into which the support shaft 110 is movably inserted, and supports the holding member 140, which will be described later.

The first support portion 120 includes a bearing portion 121 to rotatably support one end 141*a* of a first link member 141 included in the holding member 140.

The second support portion 130 includes a bearing portion 131 to rotatably support one end 142*a* of a second link member 142 included in the holding member 140. In addition, the second support portion 130 includes a well-known free stop mechanism so that, after the second support portion 130 moves in the vertical direction (Z direction) along the axial center of the support shaft 110 in a state of rotatably supporting one end 142*a* of the second link member 142, the position thereof in the vertical direction is maintained by the well-known free stop mechanism.

(1.4) Holding Member

The holding member 140 is constituted by a parallelogram-shaped link mechanism 410 which includes the first link member 141 of which one end 141*a* is rotatably supported by the first support portion 120 and the second link member 142 of which one end 142*a* is rotatably supported by the second support portion 130 and the other end is rotatably connected to an intermediate portion 141*c* of the first link member 141, and an abutting member 160 which stops a sheet P as a recording material at the leading end portion of the parallelogram-shaped link mechanism 410.

The parallelogram-shaped link mechanism 410 is constituted by the first link member 141 of which one end 141*a* is rotatably supported by the first support portion 120, the second link member 142 of which one end 142*a* is rotatably supported by the second support portion 130 and the other end 142*b* is rotatably connected, to the intermediate portion 141*c* of the first link member 141, a third link member 143 of which an intermediate portion 143*c* is rotatably connected to the other end 141*b* of the first link member 141, and a fourth link member 144 of which one end 144*a* is connected to one end 143*a* of the third link member 143 and the other end 144*b* is connected to an intermediate portion 142*c* of the second link member 142.

The material of the first, second, third, and fourth link members 141, 142, 143, and 144 constituting the parallelogram-shaped link mechanism 410 is not particularly limited, and may employ a thin plate material made of an aluminum alloy having a channel structure, a synthetic polymer containing a reinforcing material, or a carbon-fiber-reinforced polymer. The holding member 140 may be reduced in weight while maintaining the strength and durability by using such a material.

The other end 143*b* of the third link member 143 is connected to one end 160*a* of the abutting member 160.

The abutting member 160 is made of a foldable wire material of which the surface is covered with an elastic member. Specifically, the surface of the wire material made of metal is formed to be coated with an elastomer polymer as an example of the elastic member. In addition, the elastic member is not limited thereto and may be a rubber member.

MODIFICATION EXAMPLE

As a modification example, the holding member 140A may be constituted by the parallelogram-shaped link mechanism 410 which includes the first link member 141 of which one end 141*a* is rotatably supported by the first support portion 120 and the second link member 142 of which one end 142*a* is rotatably supported by the second support portion 130 and the other end 142*b* is rotatably connected to the intermediate portion 141*c* of the first link member 141, a second parallelogram-shaped link mechanism 420 connected to the other end 141*b* of the first link member 141, and the abutting member 160 which stops a sheet P as the recording material at the leading end portion of the second parallelogram-shaped link mechanism 420.

The parallelogram-shaped link mechanism 410 is constituted by the first link member 141 of which one end 141*a* is rotatably supported by the first support portion 120, the second link member 142 of which one end 142*a* is rotatably supported by the second support portion 130 and the other end 142*b* is rotatably connected to the intermediate portion 141*c* of the first link member 141, the third link member 143 of which the intermediate portion 143*c* is rotatably connected to the other end 141*b* of the first link member 141, and the fourth link member 144 of which one end 144*a* is connected to one end 143*a* of the third link member 143 and the other end 144*b* is connected to the intermediate portion 142*c* of the second link member 142.

The second parallelogram-shaped link mechanism 420 is constituted by the third link member 143 of which the intermediate portion 143*c* is connected to the other end 141*b* of the first link member 141, a fifth link member 145 of which an intermediate portion 145*c* is connected to the other end 143*b* of the third link member 143, and a wire material 146 of which one end 146*b* is connected to one end 145*a* of the fifth link member 145 and the other end 146*a* is connected to an intermediate portion 141*d* of the first link member 141.

In addition, an intermediate point 146*c* of the wire material 146 is supported by the intermediate portion 143*c* of the third link member 143 with a ring 147.

Furthermore, one end 160*a* of the abutting member 160 is connected to the other end 145*b* of the fifth link member 145.

When the holding member 140A of the modification example is used, by increasing the length of the deployed discharged sheet accommodating device 1, longer sheets P, for example, A3 broad size (328 mm×453 mm) or 12 in×19 in (304.8 mm×482.6 mm) sheets P may be stacked and accommodated.

(1.5) Receiving Member

On one surface side of the holding member 140 (140A) having the above configuration on which the discharged sheet P is received, one end side of the receiving member 150 is fixed to the support shaft 110 and the other end side thereof is held by the abutting member 160 to be extensible and contractible. Therefore, when the holding member 140 (140A) is deployed to the side of the image forming apparatus 2, the shape of the receiving surface which receives the sheet P may be appropriately adjusted in accordance with the type of the sheet P.

As the material of the receiving member 150, a sheet material having flexibility, specifically, fabric made of flame-retardant polyester fiber is employed. Particularly, since the receiving member 150 is connected to the image forming apparatus 2 to be used, in order to suppress catching fire from the outside, flame-retardant fabric is preferable.

(1.6) Operation of Discharged Sheet Accommodating Device

In a case where the sheet P discharged from the sheet outlet port of the image forming apparatus 2 is stacked and accommodated in the discharged sheet accommodating device 1, as illustrated in FIG. 3A, from a state where the holding member 140 and the receiving member 150 which are connected to the side surface of the apparatus body of the image forming apparatus 2 where the sheet outlet port is provided and are closed, the holding member 140 and the receiving member 150 are deployed, to cause the receiving member 150 to have a wavy shape in the cross-sectional view.

In the discharged sheet accommodating device 1, when the second support portion 130 by which one end 142*a* of the second link member 142 is rotatably supported is moved downward in the vertical direction (−Z direction) along the axial line of the support shaft 110, the first link member 141 rotates about one end 141*a* rotatably supported by the first support portion 120, and the other end 141*b* of the first link member 141 is moved in the up and down direction (−Z direction) and in the horizontal direction (X direction).

In addition, a part of the third link member 143 including the intermediate portion 143*c* and one end 143*a*, and the fourth link member 144 are also moved so that the parallelogram shape is folded. As a result, the other end 143*b* of the third link member 143 and the abutting member 160 are moved in the up and down direction (−Z direction) and in the horizontal direction (X direction).

As described above, in the discharged sheet accommodating device 1 constituted by the support shaft 110 and the holding member 140 including the parallelogram-shaped link mechanism 410, the second support portion 130 into which the support shaft 110 is inserted is moved downward in the vertical direction (−z direction) along the axial line of the support shaft 110, and in a case where the second support portion 130 is held at a predetermined position, a connection point P1 between one end 144*a* of the fourth link member 144 and one end 143*a* of the third link member 143 and a stop position P2 of the abutting member 160 connected to the other end 143*b* of the third link member 143 are uniquely determined.

Therefore, by adjusting the holding position of the second support portion 130 on the lower side in the vertical direction (−z direction) along the axial line of the support shaft 110, the connection point P1 (hereinafter, referred to as a sheet receiving position P1) and the stop position P2 are uniquely determined in accordance with the discharge direction of the sheet P from the sheet outlet port of the connected image forming apparatus 2 and the type of the sheet P, and thus the sheet P may be received without falling.

In addition, regarding the receiving member 150 of which one end 150*a* is fixed to the support shaft 110 and of which the other end 150*b* is held by the abutting member 160 to be extensible and contractible, the position of the other end 150*b* thereof fixed to the abutting member 160 is appropriately adjusted, thereby appropriately adjusting the shape of the receiving surface in accordance with the type of the sheet P according to the shape of the deployed holding member 140 (140A).

(2) Action and Effect of Discharged Sheet Accommodating Device

Figure 4:
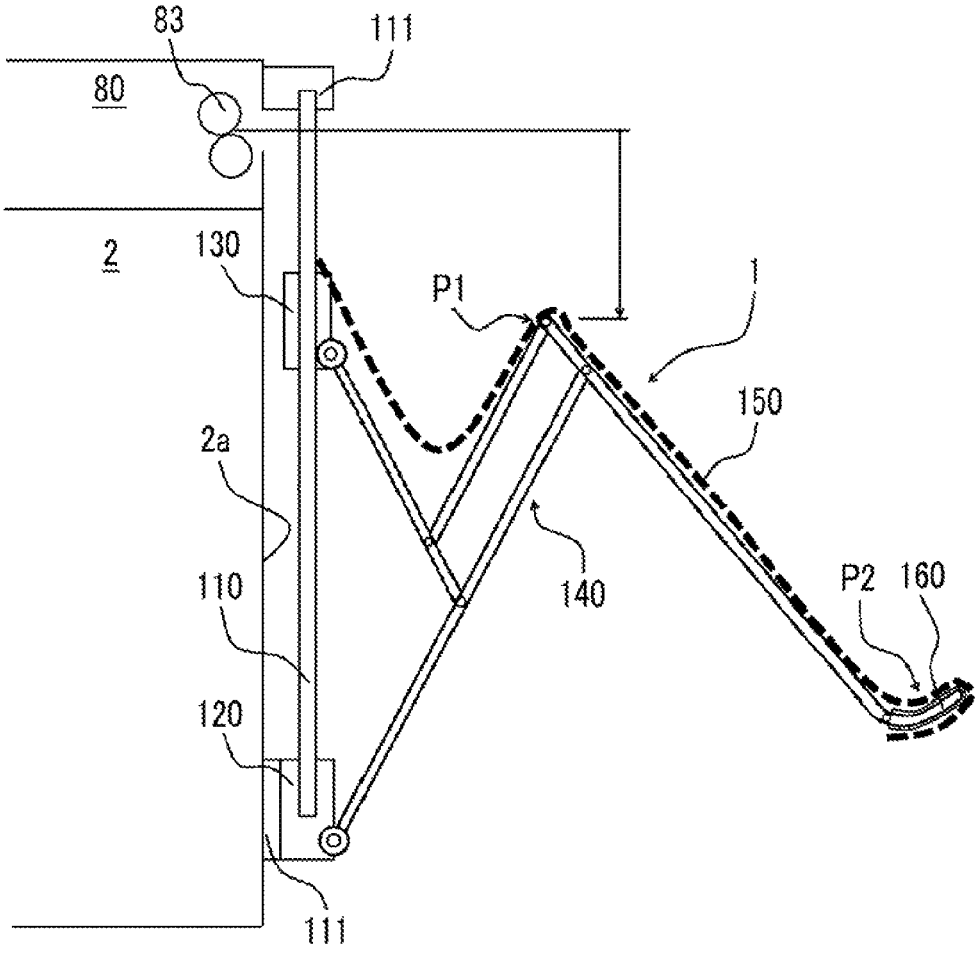
FIG. 4 is an overall schematic view illustrating connection of the discharged sheet accommodating device to an image forming apparatus.
Figure 5A:
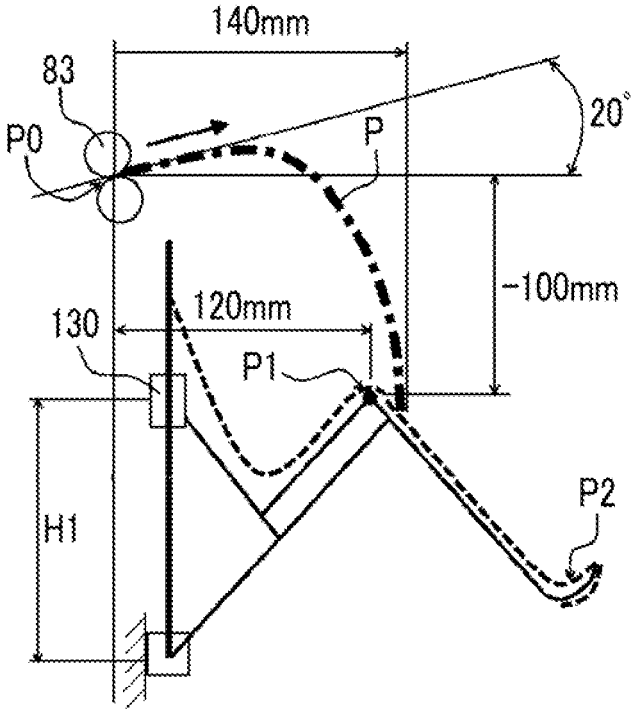
FIGS. 5A and 5B are conceptual views illustrating the relationship between the posture of a sheet discharged from an outlet port of the image forming apparatus and a sheet receiving position.
Figure 5B:
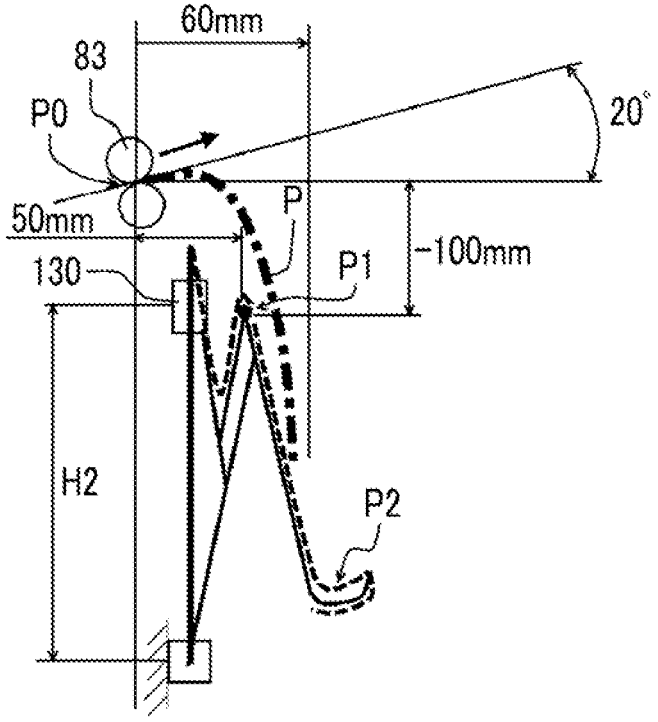
Figure 6:
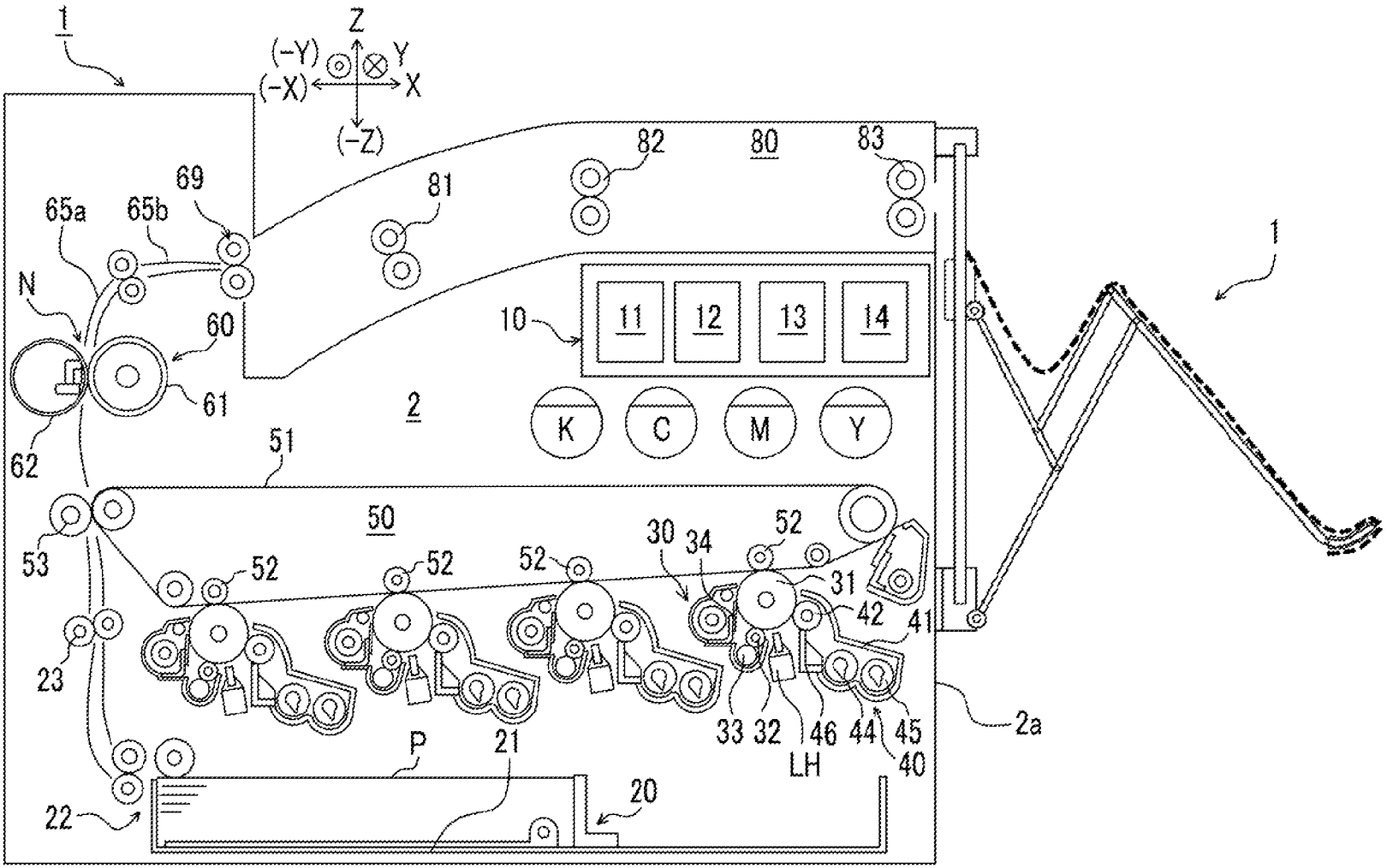
FIG. 6 is a schematic cross-sectional view illustrating the internal configuration of the image forming apparatus to which the discharged sheet accommodating device is connected.

FIG. 4 is an overall schematic view illustrating connection of the discharged sheet accommodating device 1 to the image forming apparatus 2, FIGS. 5A and 5B are conceptual views illustrating a relationship between a posture of the sheet P discharged from the outlet port of the image forming apparatus 2 and a sheet receiving position, and FIG. 6 is a schematic cross-sectional view illustrating an internal configuration of the image forming apparatus 2 to which the discharged sheet accommodating device 1 is connected.

Hereinafter, the action of the discharged sheet accommodating device 1 according to this exemplary embodiment will be described according to an example in which the image forming apparatus 2 is used.

(2.1) Entire Configuration and Operation of Image Forming Apparatus

The image forming apparatus 2 is configured to include a control device 10, a sheet feeding device 20, photoconductor units 30, developing devices 40, a transfer device 50, a fixing device 60, and a transporting device 80.

The control device 10 includes an image forming apparatus control unit 11 which controls the operation of the image forming apparatus 2, a controller unit 12 which prepares image data according to a printing request, an exposure control unit 13 which controls the lighting of an exposing device LH, a power source device 14, and the like. The power source device 14 applies voltages to charging rollers 32, developing rollers 42, primary image transfer rollers 52, secondary image transfer rollers 53, and the like, which will be described later, and supplies power to the exposing device LH.

The controller unit 12 converts print information input from an external information transmitting device (for example, a personal computer) info image information for forming a latent image, and outputs a driving signal to the exposing device LH at a predetermined timing. The exposing device LH of this exemplary embodiment is configured as an LED head in which LEDs (light emitting diodes) are linearly arranged.

At the bottom portion of the image forming apparatus 2, the sheet feeding device 20 is provided. The sheet feeding device 20 includes a sheet stacking plate 21, and on the upper surface of the sheet stacking plate 21, sheets P as a number of recording media are stacked. The sheets P which are stacked on the sheet stacking plate 21 and of which the positions in the width direction are determined by a regulating plate (not illustrated) are drawn forward (−X direction) one by one from the top by a sheet drawing unit 22 and thereafter are transported to a nip portion of a pair of registration rollers 23.

The photoconductor units 30 are provided above (in the Z direction) the sheet feeding device 20 in parallel and respectively include photosensitive drums 31 as image holding members that are driven to rotate. The charging roller 32, the exposing device LH, the developing device 40, the primary image transfer roller 52, and a cleaning blade 34 are arranged along the photosensitive drum 31 in the direction of rotation. A cleaning roller 33 which cleans the surface of the charging roller 32 is disposed to oppose and come into contact with the charging roller 32.

The developing device 40 includes a developing housing 41 which accommodates a developer therein. In the developing housing 41, the developing roller 42 which is disposed to oppose the photosensitive drum 31, and a pair of augers 44 and 45 which agitate the developer to be transported to the developing roller 42 side are disposed obliquely on the lower side of the back surface side of the developing roller 42. A layer regulating member 46 which regulates the layer thickness of the developer is disposed close to the developing roller 42.

The developing devices 40 have substantially the same configuration except for the developers accommodated in the developing housings 41 and respectively form toner images of yellow (Y), magenta (M), cyan (C), and black (K).

The surface of the rotating photosensitive drum 31 is charged by the charging roller 32, and on the surface, an electrostatic latent image is formed by a latent image forming light emitted by the exposing device LH. The electrostatic latent image formed on the photosensitive drum 31 is developed as a toner image by the developing roller 42.

The transfer device 50 includes an intermediate image transfer belt 51 on which the respective color toner images formed by the photosensitive drums 31 of the photoconductor units 30 are transferred to be superposed, and the primary image transfer rollers 52 which sequentially transfer (primarily transfer) the color toner images respectively formed by the photoconductor units 30 onto the intermediate image transfer belt 51. The transfer device 50 is configured to further include the secondary image transfer rollers 53 which collectively transfer (secondarily transfer) the color toner images respectively transferred onto the intermediate image transfer belt 51 to be superposed, onto the sheet P which is the recording medium.

The color toner images respectively formed on the photosensitive drums 31 of the photoconductor units 30 are sequentially, electrostatically transferred (primarily transferred) onto the intermediate image transfer belt 51 by the primary image transfer rollers 52 to which a predetermined transfer voltage is applied by the power source device 14 or the like controlled by the image forming apparatus control unit 11, thereby forming a superposed toner images in which toners of the respective colors are superposed.

The superposed toner images on the intermediate image transfer belt 51 are transported to a region (secondary image transfer portion T) where the secondary image transfer rollers 53 are arranged, along of the movement of the intermediate image transfer belt 51. When the superposed toner images are transported to the secondary image transfer portion T, the sheet P is supplied to the secondary image transfer portion T from the sheet feeding device 20 according to timing. In addition, a predetermined transfer voltage is applied to the secondary image transfer rollers 53 from the power source device 14 controlled by the image forming apparatus control unit 11, and the superposed toner images on the intermediate image transfer belt 51 are collectively transferred onto the sheet P that is sent from the pair of registration rollers 23 and is guided by a transportation guide.

Residual toner on the surface of the photosensitive drum 31 is removed by the cleaning blade 34 and is recovered by a waste developer accommodating unit. The surface of the photosensitive drum 31 is re-charged by the charging roller 32. Residual matter that has not been removed by the cleaning blade 34 and adheres to the charging roller 32 is trapped on the surface of the cleaning roller 33 that is rotated while coming into contact with the charging roller 32, so as to be accumulated.

The fixing device 60 includes a heating module 61 and a pressing module 62, and a fixing nip portion N (fixing region) is formed by a pressure contact region between the heating module 61 and the pressing module 62.

The sheet P onto which the toner images are transferred by the transfer device 50 is transported to the fixing device 60 via the transportation guide in a state where the toner images are not fixed yet. The sheet P transported to the fixing device 60 is brought into pressure contact with and is heated by the heating module 61 and the pressing module 62 which form a pair, thereby fixing the toner images.

The sheet P on which the fixed toner image is formed is guided by transportation guides 65*a* and 65*b* and is discharged to the transporting device 80 disposed on the upper surface of the image forming apparatus 2 from a pair of discharge rollers 69.

The transporting device 80 includes inlet port rollers 81 which receive the sheet P output via the pair of discharge rollers 69 of the image forming apparatus 2, first feed rollers 82 which transport the sheet P received by the inlet port rollers 81, to the downstream side, and second feed rollers 83 which transport the sheet P toward, the discharged sheet accommodating device 1.

(2.2) Sheet Receiving Position

As illustrated in FIG. 4, in the discharged sheet accommodating device 1 connected to the sheet outlet port side of the image forming apparatus 2, the sheet receiving position P1 is disposed on the lower side in the vertical direction (Z direction) with respect to the sheet outlet port of the second feed rollers 83 of the transporting device 80.

FIGS. 5A and 5B illustrate examples of a relationship between the sheet receiving position P1 of the discharged sheet accommodating device 1 connected as described above, a position P0 of the second feed rollers 83 in the horizontal direction (X direction) and in the vertical direction (Z direction), and the discharge direction of the sheet P.

Hereinafter, with respect to the nip position P0 of the second feed rollers 83 as the reference (0 mm, 0 mm), a position of the sheet receiving position P1 in the horizontal direction (X direction) is referred to as Px, and a position thereof in the vertical direction (Z direction) is referred to as Pz.

Discharge Conditions of Sheet P

Discharge speed: 100 mm/s (A4 paper)

Discharge angle: 20°

Discharge method: no corrugation

Sheet type: plain paper (64 gsm), thin paper (52 gsm)

Plain paper

As illustrated in FIG. 5A, the sheet P comes into contact with the receiving surface at a point where the sheet P is discharged from the nip position P0 (0 mm, 0 mm) of the second feed rollers 33 by 140 mm in the horizontal direction. Therefore, the holding position of the second support portion 130 is adjusted (H1 in FIG. 5A) so that the sheet receiving position P1 is positioned at Px=120 mm and Pz=100 mm.

As a result, the sheet P comes into contact with the receiving surface at a position where the leading end portion thereof passes the sheet receiving position P1, and thereafter is transported onto the receiving surface, and the leading end portion thereof is accommodated in the abutting member 160 while the sheet is aligned.

Thin Paper

As illustrated in FIG. 5B, the sheet P comes into contact with the receiving surface at a point where the sheet P is discharged from the nip position P0 (0 mm, 0 mm) of the second feed rollers 83 by 60 mm in the horizontal direction. Therefore, the holding position of the second support portion 130 is adjusted (H2 in FIG. 5B) so that the sheet receiving position P1 is positioned at Px=50 mm and Pz=100 mm.

As a result, the sheet P comes into contact with the receiving surface at a position where the leading end portion thereof passes the sheet receiving position P1 so as to be transported on the receiving surface, and the leading end portion thereof is accommodated in the abutting member 160 while the sheet is aligned.

The discharged sheet accommodating device 1 according to this exemplary embodiment may be deployed so that the sheet receiving position P1 is positioned on the lower side in the vertical direction (Z direction) with respect to the sheet outlet port of the second feed rollers 83 of the transporting device 80 and by adjusting the holding position of the second support portion 130, the leading end portion of the sheet P comes into contact with the receiving surface at the position where the leading end portion of the sheet P passes the sheet receiving position P1, according to the type of the sheet P.

Therefore, according to the length of the discharged sheet, the sheet P may be received without falling. In addition, even in a case of using thin paper which has no stiffness, the discharged sheet accommodating device 1 may be deployed so that the sheet receiving position P1 becomes close to the sheet outlet port and thus the leading end portion of the sheet P may be guided to the receiving surface.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are salted to the particular use contemplated. It is intended that the scope of the invention be defined by the following claims and their equivalents.

What is claimed is:

1. A discharged sheet accommodating device comprising:

a support shaft that has an axial center in a vertical direction and is mounted on an apparatus body of an image forming apparatus that is provided with an outlet port from which a recording material is discharged;

a first support portion that is provided to be fixed to a lower end of the support shaft in an axial center direction;

a second support portion into which the support shaft is movably inserted and moves in an axial line direction of the support shaft; and a holding member of which one end is supported by the first support portion and the second support portion, and which is movable in an up and down direction and in a horizontal direction while being folded, wherein, the holding member includes:

a folded portion that is folded to have a protruding shape to be pointed upwards in the vertical direction, and the folded portion is positioned on a lower side of the outlet port in the vertical direction; and an abutting member that stops the recoding material, and a parallelogram-shaped link mechanism that includes a first link member of which one end is rotatably supported by the first support portion, and a second link member of which one end is rotatably supported by the second support portion and the other end of the second link member is rotatably connected to an intermediate portion of the first link member; and the abutting member stops the recording material at a leading end portion of the parallelogram-shaped link mechanism, and wherein the recording material discharged from the outlet port is accommodated in the holding member in a state of contacting with the folded portion and the abutting member.

2. The discharged sheet accommodating device according to claim 1, wherein a position of the folded portion with respect to the outlet port is determined by a position where the second support portion is held in the axial line direction of the support shaft.

3. The discharged sheet accommodating device according to claim 1, wherein the holding member includes:

a second parallelogram-shaped link mechanism that is connected to the other end of the first link member.

4. The discharged sheet accommodating device according to claim 2, wherein the holding member includes:

a second parallelogram-shaped link mechanism that is connected to the other end of the first link member.

5. The discharged sheet accommodating device according to claim 1, further comprising:

a receiving member of which one end is fixed to the support shaft and the other end is held by a leading end portion of the holding member to be extensible and contractible, and which receives the recording material, wherein the receiving member comprises a sheet member.

6. The discharged sheet accommodating device according to claim 2, further comprising:

a receiving member of which one end is fixed to the support shaft and the other end is held by a leading end portion of the holding member to be extensible and contractible, and which receives the recording material, wherein the receiving member comprises a sheet member.

7. The discharged sheet accommodating device according to claim 3, further comprising:

a receiving member of which one end is fixed to the support shaft and the other end is held by a leading end portion of the holding member to be extensible and contractible, and which receives the recording material, wherein the receiving member comprises a sheet member.

8. The discharged sheet accommodating device according to claim 1, wherein the abutting member comprises a foldable wire material of which a surface is covered with an elastic member.

9. The discharged sheet accommodating device according to claim 1, further comprising:

a receiving member of which one end is fixed to the support shaft and the other end is held by a leading end portion of the holding member to be extensible and contractible, and which receives the recording material.

10. A discharged sheet accommodating device comprising:

a support shaft that has an axial center in a vertical direction and is mounted on an apparatus body of an image forming apparatus that is provided with an outlet port from which a recording material is discharged;

a first support portion that is provided to be fixed to a lower end of the support shaft in an axial center direction;

a second support portion into which the support shaft is movably inserted and moves in an axial line direction of the support shaft; and a holding member of which one end is supported by the first support portion and the second support portion, and which is movable in an up and down direction and in a horizontal direction while being folded, wherein, the holding member includes:

a first link member of which one end is rotatably supported by the first support portion;

a second link member of which one end is rotatably supported by the second support portion and the other end is rotatably connected to the first link member at a first position;

a third link member of which one end is rotatably connected to the first link member at a position different from the first position; and an abutting member that stops the recording material, the abutting member being connected to the other end of the third link member.

11. The discharged sheet accommodating device according to claim 10, wherein the holding member includes a folded portion, and wherein a position of the folded portion with respect to the outlet port is determined by a position where the second support portion is held in the axial line direction of the support shaft.

12. The discharged sheet accommodating device according to claim 10, further comprising:

a receiving member of which one end is fixed to the support shaft and the other end is held by a leading end portion of the holding member to be extendible and contractible, and which receives the recording material, wherein the receiving member comprises a sheet member.

13. The discharged sheet accommodating device according to claim 10, wherein the abutting member comprises a foldable wire material of which a surface is covered with an elastic member.

14. A discharged sheet accommodating device comprising:

a support shaft that has an axial center in a vertical direction and is mounted on an apparatus body of an image forming apparatus that is provided with an outlet port from which a recording material is discharged;

a first support portion that is provided to be fixed to a lower end of the support shaft in an axial center direction;

a second support portion into which the support shaft is movably inserted and moves in an axial line direction of the support shaft;

a holding member of which one end is supported by the first support portion and the second support portion, and which is movable in an up and down direction and in a horizontal direction while being folded; and a receiving member of which one end is fixed to the support shaft and the other end is held by a leading end portion of the holding member to be extendible and contractible, and which receives the recording material, wherein the receiving member comprises a sheet member.

* * * * *